US005769144A

United States Patent [19]

Carter

[11] Patent Number: 5,769,144

[45] Date of Patent: Jun. 23, 1998

[54] EYELET REINFORCEMENT FOR CURTAINS

[76] Inventor: Damon A. Carter, 320 Newbury St., Unit 106, Danvers, Mass. 01923

[21] Appl. No.: 707,519

[22] Filed: Sep. 4, 1996

[51] Int. Cl.[6] ..... A47H 1/00

[52] U.S. Cl. ..... 160/330; 160/123; 160/DIG. 6; 411/338; 411/508

[58] Field of Search ..... 160/330, DIG. 6, 160/123, 124; 411/508, 509, 510, 338, 339, 258, 930

[56] References Cited

U.S. PATENT DOCUMENTS

| | | | |
|---|---|---|---|
| 2,148,401 | 2/1939 | Ellis, Jr. | 160/DIG. 6 |
| 2,797,605 | 7/1957 | Metzke, Jr. et al. | 411/339 |
| 3,115,804 | 12/1963 | Johnson | 411/508 |
| 3,118,207 | 1/1964 | Breslow | 160/330 X |
| 3,238,835 | 3/1966 | Rosenberg | 411/338 |
| 3,251,260 | 5/1966 | Serdechny | 411/338 |
| 4,543,139 | 9/1985 | Freedman et al. | 156/152 |
| 4,822,224 | 4/1989 | Carl et al. | 411/258 X |
| 4,830,558 | 5/1989 | Sweeney | 411/258 |
| 5,000,627 | 3/1991 | Adams | 411/510 |
| 5,069,586 | 12/1991 | Casey | 411/508 X |
| 5,111,868 | 5/1992 | Sawaya . | |
| 5,143,500 | 9/1992 | Schuring et al. | 411/508 X |
| 5,339,491 | 8/1994 | Sims | 411/339 X |
| 5,339,884 | 8/1994 | Angerman | 160/330 |
| 5,417,530 | 5/1995 | Grossner | 411/258 |

*Primary Examiner*—Daniel P. Stodola
*Assistant Examiner*—Bruce A. Lev
*Attorney, Agent, or Firm*—Don Halgren

[57] ABSTRACT

An eyelet reinforcement for application to an eyelet of a thin polymer sheet, for the repairing and strengthening of that sheet and eyelet, comprising a first disc of plastic having a first generally hemispherically shaped side and a second planar side, a centrally disposed bore extending through the first disc, from its first side to its second side, and a hollow standoff extending off of the second side of the first disc, in coaxial alignment with the bore in the first disc. A second disc of plastic is arrangable matingly opposed to the first disc, having a first generally hemispherically shaped side and a second planar side, a centrally disposed bore extending through the second disc from its first side to its second side, and an annular surface surrounds each of the bores on the planar sides of the first and second discs. A radially outwardly extending ridge is disposed on the distal end of the standoff, to engage the bore of the second disc, so as to securely maintain any sheet between the discs when the discs are pressed together.

10 Claims, 3 Drawing Sheets

EYELET REINFORCEMENT FOR CURTAINS

BACKGROUND OF THE INVENTION

1. Field of the Invention

This invention relates to an apparatus for reinforcing eyelet holes on flexible sheet material such as shower curtains, rubber sheets, tarps, fabric or the like.

2. Prior Art

Shower curtains and shower curtain liners are typically made out of a thin vinyl material having a plurality of space to part eyelets across an upper edge thereof. Each eyelet is used to receive a ring, which ring also is supported about a curtain rod. After all too short a time, the eyelets which contain these rings, become worn and torn. Curtain manufacturers typically do provide a minimal amount of material around these islets, but it never seems to be enough.

There are attempts in the prior art to provide reinforcement devices for torn eyelets in vinyl shower curtains. One such attempt is shown in U.S. Pat. No. 5, 111,868 to Sawaya, entitled "Replaceable Eyelet for Flexible Curtains". This particular islet utilizes a pair of hingably attached ring members, which between them sandwich the eyelet portion of the torn curtain. This device also utilizes a cutting element to secure the reinforcement member to the curtain. Unfortunately, much of the weight of the curtain appears to be supported by a very thin cutting element which itself is likely to create more tears or rips, than it repairs.

It is an object of the present invention to overcome the disadvantages of the prior art.

It is a further object of the present invention, to provide a flexible curtain reinforcement arrangement which may be utilizable by a number of different thickness curtains.

It is yet a further object of the present invention to provide a curtain eyelet reinforcement means which has multiple securement means arranged therewith.

BRIEF SUMMARY OF THE INVENTION

The present invention comprises a eyelet reinforcement arrangement made from a first and a second plastic disc. Each plastic disc has a generally hemispherically shaped outer surface on one side thereof. The first disc of the pair of plastic discs has a annular surface adjacent its periphery, the annular surface surrounding a raised ring on its other side thereof. A bore extends through the first disc, from the hemispherically shaped side and longitudinally through the raised ring. The ring has a generally radially directed peripherally disposed lip arranged therearound.

The second plastic disc has a generally planar annular surface disposed on its side opposed to its hemispherical side. The annular surface surrounds an opening which is coaxial with a bore which extends through the second disc, from one side to the other. The bore on the second disc may have a plurality of spaced apart recessed rings molded therein.

Each annular surface on each first and second disc, may have an adhesive coated thereon. Each annular disposition of adhesive will have a peelable covering film thereon so as to protect the adhesive until it is applied to a curtain.

In operation of the present invention, a first and a second disc, each about one and one quarter inches in diameter, have their appropriate film coverings removed, and are arranged on opposed sides of an eyelet of a curtain to be reinforced. The protruding ring on the first disc is pressed through the eyelet of the curtain. The bore of the second disc is pressed onto the protruding ring of the first disc, the annular ridge of the raised ring of the first disc sliding engagably into and locking with the recessed rings in the bore of the second disc.

By virtue of the plurality of recessed rings within the bore of the second disc, the two discs may be utilized to secure a plurality of laminate material together. Once the two discs have been pressed closely towards one another, their adhesive firmly securing the respective sides of the curtain, a reinforced eyelet is thus formed, the bore of each disc being coaxial with one another, to permit a supportive ring there to be introduced therethrough.

A further embodiment of the present invention includes an annular array of spaced apart curved wall segments disposed perpendicular to the annular surface of the first disc, to provide a self-piercing arrangement to cut an eyelet within that curtain. Those segments would mate with the bore on the second disc, in the manner of the aforementioned embodiment. The annular surface radially adjacent the spaced apart segments, would have the same adhesive coating and peelable covering thereon, as did the aforementioned earlier embodiment of the present invention.

The invention also comprises an eyelet reinforcement wherein the bore extends completely through the second disc, from the planar side to said hemispherical side. The second disc may have a suction cup therewith, to permit a shower curatin to which it is attached, to be secured to a shower wall. The second disc may have a hook element therewith, to permit an item to be supported onto a shower curtain to which the reinforcement member is attached.

The invention includes an eyelet reinforcement for application to an eyelet of a thin flexible sheet, for the repairing and strengthening of that sheet and eyelet, comprising a first disc of plastic having a first generally hemispherically shaped side and a second planar side, a centrally disposed bore extending through the first disc, from the first side to the second side, a hollow standoff extending off of the second side of the first disc, in coaxial alignment with the bore in the first disc, a second disc of plastic having a first generally hemispherically shaped side and a second planar side, a centrally disposed bore extending into the second disc from the first side towards the second side, an annular surface surrounding each of the bores on the planar sides of the first and second discs; and a radially outwardly extending ridge disposed on the distal end of the standoff, to engage the bore of the second disc, so as to securely maintain the sheet between the discs when the discs are pressed together. The invention includes annular surfaces surrounding each of the bores on each of the discs with a coating of adhesive thereon. The coating of adhesive has a removable protective layer of film peelably disposed thereon. The standoff comprises an annular array of spaced apart wall segments, having a sharp distal edge to permit the first disc to pierce its own opening when pressed against the receiving bore of a second disc. The first and second discs are each about 1 and ¼ inches in diameter. The bore in the second disc has a plurality of rings spaced therethrough, to provide a roughened surface for the ridge on the distal end of the standoff to securely engage. The bore extends completely through the second disc, from the planar side to the hemispherical side.

The second disc has a suction cup therewith, to permit a shower curtain to which it is attached, to be secured to a shower wall. The second disc has a hook element therewith, to permit an item to be supported onto a shower curtain to which the reinforcement is attached. The flexible sheet may be selected from the group consisting of: polymer sheet, woven canvas sheet or rubber sheets.

The invention also includes a curtain of thin flexible polymer material having at least one eyelet reinforcement thereon, the eyelet reinforcement on the curtain comprising: a first disc of plastic having a first generally hemispherically shaped side and a second planar side, a centrally disposed bore extending through the first disc, from the first side to the second side, a hollow standoff extending off of the second side of the first disc, in coaxial alignment with the bore in the first disc, a second disc of plastic having a first generally hemispherically shaped side and a second planar side, a centrally disposed bore extending into the second disc from the first side towards the second side, an annular surface surrounding each of the bores on the planar sides of the first and second discs; and a radially outwardly extending ridge disposed on the distal end of the standoff, to engage the bore of the second disc, so as to securely maintain the fabric between the discs when the discs are pressed together. The fabric or curtain being reinforced may comprise a sheet of polymer material for use as shower curtains.

Thus, there is shown a unique device for repairing eyelet holes in torn or worn vinyl shower curtains and curtain liners, tarps, tents or outdoor coverings or the like. The use of an intermating and interlocking protrusion of one disc with the receiving aperture on a second disc, together, in combination with an adhesive on the opposed surfaces of each of the first and second discs, provides a reinforcement arrangement having multiple securement means therewith. This durable reinforced eyelet arrangement may be reinstalled at a subsequent location on the final use of the particular vinyl curtain to which it is attached.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
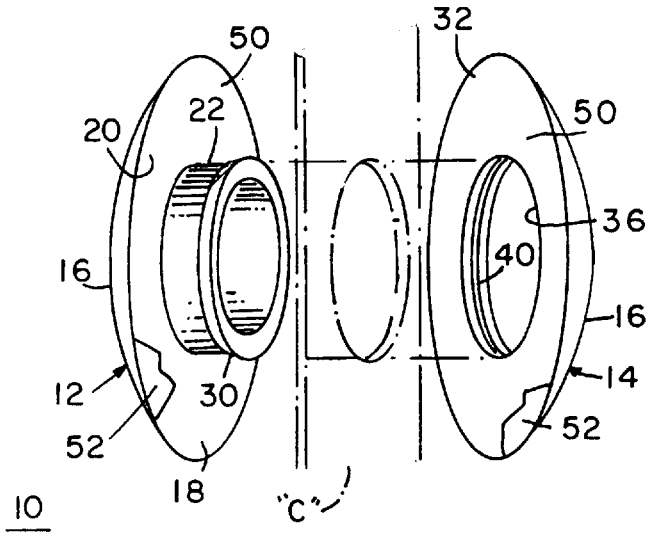
FIG. 1 is a side elevational view, in part perspective, showing the mating interrelationship of a pair reinforcement discs with a vinyl curtain spaced therebetween.
Figure 2:
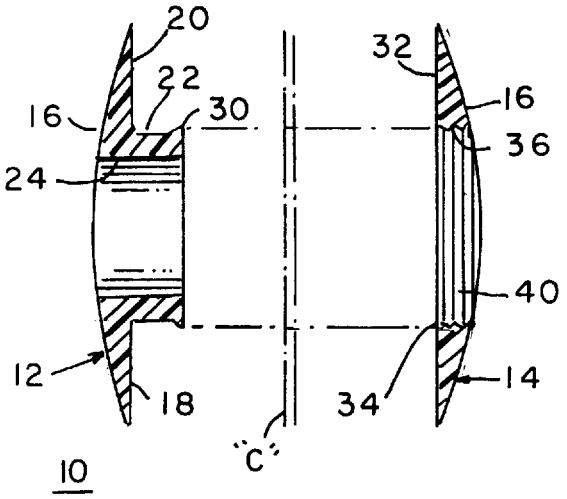
FIG. 2 is a side elevational view, in cross section, showing the spaced apart discs of FIG. 1.

The present invention comprises a eyelet reinforcement arrangement 10 made from a first and a second metal or preferrably plastic disc 12 and 14, as shown in FIGS. 1 and 2. Each disc 12 and 14 has a generally hemispherically shaped outer surface 16 on a first side thereof. The first disc 12 of the pair of discs 10 has a annular surface 18 adjacent its periphery on its second side 20, the annular surface 18 surrounding a standoff 22 on its second side 20 thereof. A bore 24 extends through the first disc 12, from the hemispherically shaped surface 16 and longitudinally through the standoff 22. The standoff 22 has a generally radially directed peripherally disposed lip 30 arranged therearound, as may be seen most clearly in FIG. 2.

The second disc 14, as shown in FIG. 1, has a generally planar annular surface 32 disposed on its second side 34, which side 34 is opposed to its hemispherical surface 16. The annular surface 32 surrounds an opening 35 which is coaxial with a bore 36 which extends through the second disc 14, from its hemispherical surface 16 to the second side 34. The bore 36 on the second disc 14 may have a plurality of spaced apart recessed rings 40 molded therein.

Each annular surface 20 and 22 on each first and second disc 12 and 14, may have an adhesive 50 coated thereon. Each annular disposition of adhesive 50 will have a peelable covering film 52 thereon so as to protect the adhesive 50 until it is applied to a curtain "C", as shown in phantom, in FIG. 1, between the discs 12 and 14.

In operation of the present invention, the first and a second disc s 12 and 14, each about one and one quarter inches in diameter, have their appropriate film coverings 52 removed so as to expose the respective adhesive layers 50, and are arranged on opposed sides of an eyelet of a curtain "C" to be reinforced. The protruding standoff 22 on the first disc 12 is pressed through the eyelet of the curtain "C". The bore 36 of the second disc 14 is pressed onto the protruding standoff 22 of the first disc 12, the annular ridge 30 of the standoff 22 of the first disc 12 sliding engagably into and locking with the recessed rings 40 in the bore 36 of the second disc 14.

By virtue of the plurality of recessed rings 40 within the bore 36 of the second disc 14, the two discs 12 and 14 may be utilized to secure a plurality of laminate material together, instead of just repairing an eyelet of a curtain. Once the two discs 12 and 14 have been pressed closely towards one another, their adhesive coatings 50 firmly securing their respective sides of the curtain "C", a reinforced eyelet is thus formed, the bore 24 and 36 of each disc 12 and 14 being coaxial with one another, to permit a supportive ring, not shown, to be introduced therethrough.

Figure 3:
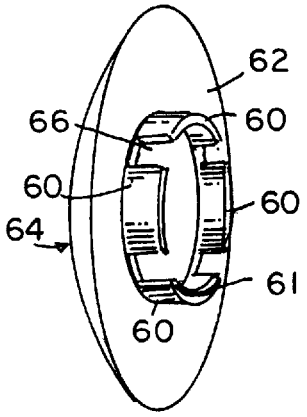
FIG. 3 is a side elevational view in perspective, of a first disc of a further embodiment of the present invention.
Figure 4:
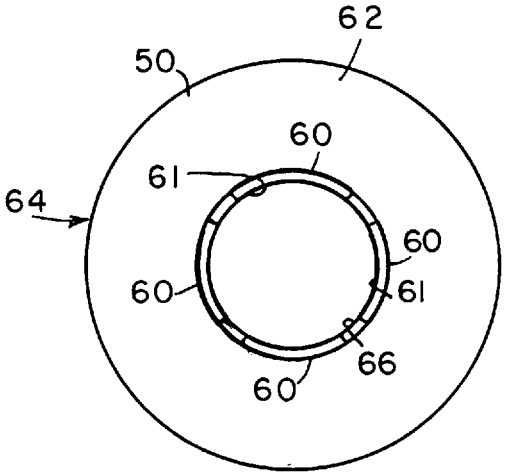
FIG. 4 is a front elevational view of the first disc shown in the further embodiment of FIG. 3.

A further embodiment of the present invention is shown in FIGS. 3 and 4, which includes a first disc 64 having an annular array of spaced apart inwardly flexible curved wall segments 60 disposed perperpendicular to an annular surface 62 of that first disc 64, to permit a self-piercing sloped or pointed outer edge 61 thereon, to cut an eyelet within that curtain sandwiched between the first disc 64, and a second disc, not shown, similar to the second disc 14 of the aforementioned embodiment. Those segments 60 would mate with the bore on the second disc, in the manner of the aforementioned embodiment. The annular surface 62 radially adjacent the spaced apart segments 60, would have the same adhesive coating 50 and peelable covering 52 thereon, as did the aforementioned earlier embodiment of the present invention.

Figure 5:
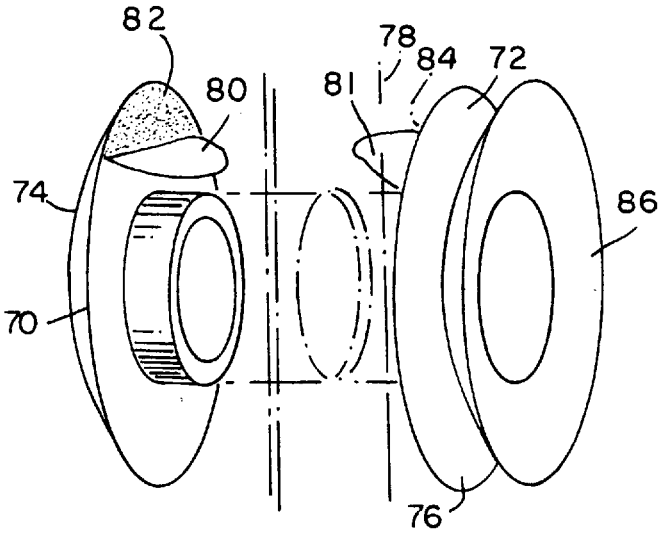
FIG. 5 is an exploded perspective view of a reinforcing disc having a suction cup adhering arrangement therewith.

A yet further embodiment is shown in FIG. 5, wherein a first and second securement disc, 70 and 72 each of which have a somewhat hemispherically shaped outer surface, 74 and 76 are shown in an exploded view, spaced apart from a shower curtain, 78 shown in phantom. The first and the second disc 70 and 72 each have a peelable sheet 80 and 81 covering an adhesive annular planar surface, 82 and 84 in a manner similar to the embodiments shown in FIGS. 1 and 2. The second disc, 72 in this embodiment however, has a suction cup 86 formed unitarily with or adhesively attached to its apex. There would be no opening going all the way through the second disc 72 of course. The securement disc arrangement with the suction cup would be suited for mating a shower curtain with a side or lower portion of a tub or shower stall wall.

Figure 6:
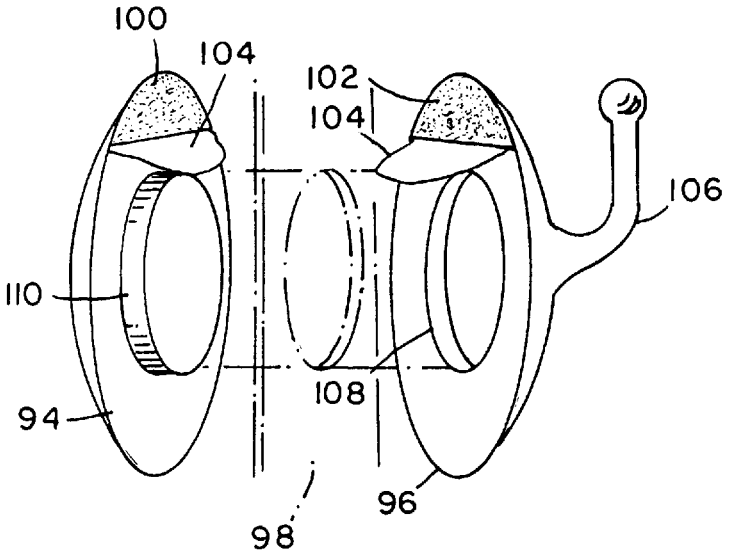
FIG. 6 is an exploded perspective view of a reinforcing disc having an article supporting hook arranged therewith.

An embodiment shown in FIG. 6, discloses a first and second support disc arrangement 94 and 96 for snapping and adhesively attaching to a shower curtain 98, each disc 94 and 96 having an annular surface 100 and 102 covered with a peelably removable sheet 104 for piercing engagement of a curtain 98 at any location where some "shower/bath" item needs to be suspended. The second disc has a hook 106 extending therefrom. The hook 106 is attached to or unitarily molded with the hemispherical side of the second disc 96. The receiving bore 108 need not extend all the way through the second disc 96, as shown in FIG. 6, the bore 108 being only deep enough to capture the standoff 110 extending from the central portion of the first disc 94. The standoff 110 may be comprised of a flexible wall of continuous or segmented portions, having an outwardly extending lip, all being matable with the bore 108 so as to permit the attachment of the hook 106 by allowing the piercing of the curtain, the hook 106 thereby being adhesively secured at any desired location thereon.

Thus, there is shown a unique device for repairing eyelet holes in torn or worn vinyl shower curtains and curtain liners, or for securing a shower curtain to a wall or for securing something to a shower curtain or fabric. The use of an intermating and interlocking protrusion of one disc with the receiving aperture on a second disc, together, in combination with an adhesive on the opposed surfaces of each of the first and second discs, provides a reinforcement arrangement having multiple securement means therewith.

I claim:

1. An eyelet reinforcement for application to an eyelet of a thin flexible sheet, for the repairing and strengthening of that sheet and eyelet, comprising:

a first disc of plastic having a first generally hemispherically shaped side and a second planar side;

a centrally disposed bore extending through said first disc, from said first side to said second side;

a hollow standoff extending off of said second side of said first disc, in coaxial alignment with said bore in said first disc;

a second disc of plastic having a first generally hemispherically shaped side and a second planar side;

a centrally disposed bore extending through said second disc from said first side towards said second side, said bore in said second disc having a plurality of rings spaced therethrough, to provide a roughened surface for said ridge on the distal end of said standoff to securely engage;

an annular surface surrounding each of said bores on said planar sides of said first and second discs; and a radially outwardly extending ridge disposed on the distal end of said standoff, to engage one of said rings within said bore within said second disc, so as to securely maintain said sheet between said discs when said discs are pressed together.

2. The eyelet reinforcement as recited in claim 1, wherein said annular surfaces surrounding each of said bores on each of said discs has a coating of adhesive thereon.

3. The eyelet reinforcement as recited in claim 2, wherein said coating of adhesive has a removable protective layer of film peelably disposed thereon.

4. The eyelet reinforcement as recited in claim 1, wherein said standoff comprises an annular array of spaced apart wall segments, having a sharp distal edge to permit said first disc to pierce its own opening when pressed against the receiving bore of a second disc.

5. The eyelet reinforcement as recited in claim 1, wherein said first and second discs are each about 1 and ¼ inches in diameter.

6. The eyelet reinforcement as recited in claim 1, wherein said bore extend completely through said second disc, from said planar side to said hemispherical side.

7. The eyelet reinforcement as recited in claim 1, wherein said second disc has a suction cup therewith, to permit a shower curatin to which it is attached, to be secured to a shower wall.

8. The eyelet reinforcement as recited in claim 1, wherein said second disc has a hook element therewith, to permit an item to be supported onto a shower curtain to which said reinforcement is attached.

9. A curtain of thin flexible polymer material having at least one eyelet reinforcement thereon, said eyelet reinforcement on said curtain comprising:

a first disc of plastic having a first generally hemispherically shaped side and a second planar side;

a centrally disposed bore extending through said first disc, from said first side to said second side;

a hollow standoff extending off of said second side of said first disc, in coaxial alignment with said bore in said first disc;

a second disc of plastic having a first generally hemispherically shaped side and a second planar side;

a centrally disposed bore extending through said second disc from said first side towards said second side, said bore within said second disc having a plurality of rings spaced therethrough, to provide a roughened surface for said ridge on the distal end of said standoff to securely engage;

an annular surface surrounding each of said bores on said planar sides of said first and second discs; and a radially outwardly extending ridge disposed on the distal end of said standoff, to engage said bore within said second disc, so as to securely maintain said curtain between said discs when said discs are pressed together.

10. The curtain reinforcement arrangement as recited in claim 9, wherein said curtain being reinforced comprises a sheet of polymer material for use as shower curtains.

* * * * *